United States Patent [19]

Britt et al.

[11] 4,319,792

[45] Mar. 16, 1982

[54] SHELF STRUCTURE

[75] Inventors: Ronald L. Britt, Middletown, Ohio; Delmar E. Benjamin, Kent, Wash.

[73] Assignee: The Celotex Corporation, Tampa, Fla.

[21] Appl. No.: 135,371

[22] Filed: Mar. 31, 1980

[51] Int. Cl.[3] ..... A47B 67/02; A47B 45/00

[52] U.S. Cl. ..... 312/245; 312/350; 211/153; 211/208; 108/107; 108/110

[58] Field of Search ..... 312/245, 350; 211/135, 211/153, 208; 248/243, 244, 201, 247; 108/107, 110

[56] References Cited

U.S. PATENT DOCUMENTS

| | | | |
|---|---|---|---|
| 569,640 | 10/1896 | Hartzell | 248/244 |
| 1,059,464 | 4/1913 | Hine | 108/107 |
| 1,080,203 | 12/1913 | Dungan | 108/107 |
| 1,938,871 | 12/1933 | Smith | 211/135 |
| 2,095,130 | 10/1937 | Gates | 211/153 |
| 3,070,234 | 12/1962 | Deitchman | 108/107 |
| 3,265,456 | 8/1966 | Woolever | 312/350 |
| 3,298,764 | 1/1967 | Goldfarb | 312/245 |
| 3,317,056 | 5/1967 | Alpert | 211/208 |
| 3,323,656 | 6/1967 | Weiss et al. | 211/153 |
| 3,807,572 | 4/1974 | Luvara et al. | 108/110 |

FOREIGN PATENT DOCUMENTS

| | | | |
|---|---|---|---|
| 18698 | of 1912 | United Kingdom | 108/107 |
| 222045 | 9/1924 | United Kingdom | 108/110 |
| 838359 | 6/1960 | United Kingdom | 211/135 |

*Primary Examiner*—Victor N. Sakran
*Attorney, Agent, or Firm*—James W. Grace; Charles W. Vanecek

[57] ABSTRACT

A shelf structure includes a shelf body having a pair of spaced gripping and strengthening projections, each projection extending longitudinally from one side edge to the other along the undersurface of said shelf body and being integrally attached to said undersurface. The shelf structure is removably attached to two opposed side supports, as, e.g., the side walls of a bathroom cabinet, by engagement of each of the gripping projections at its sides with opposed lateral projections on each of the side supports.

10 Claims, 4 Drawing Figures

FIG. 1
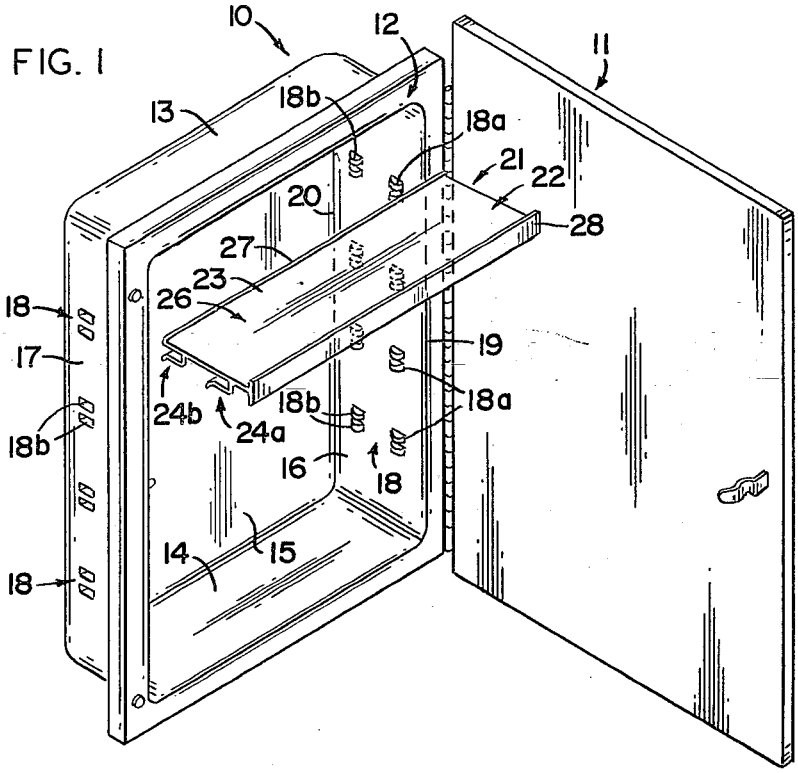
FIG. 2
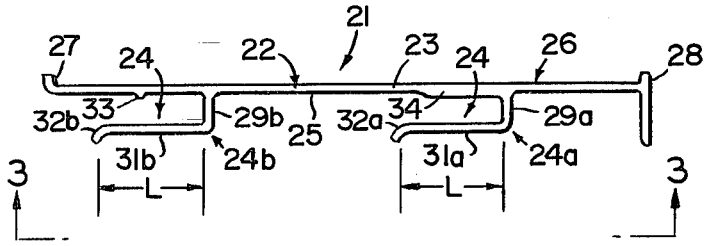
FIG. 3
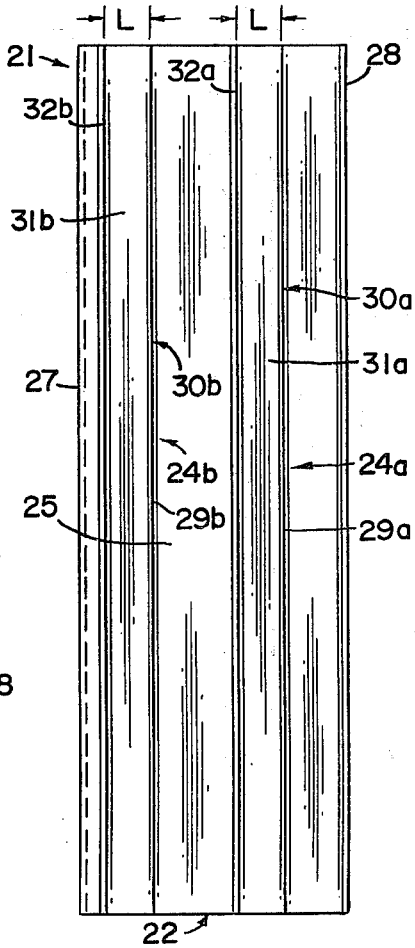
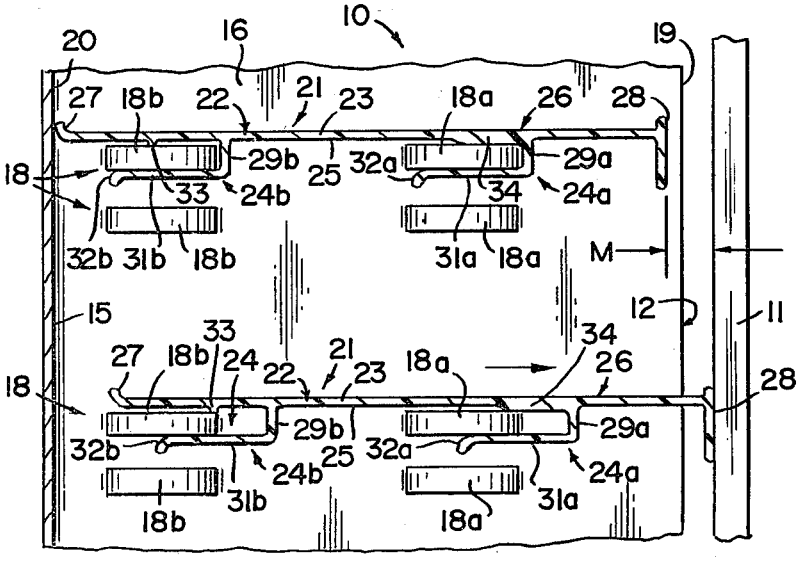
FIG. 4

SHELF STRUCTURE

BACKGROUND OF THE INVENTION

1. Field of the Invention

This invention relates to a shelf structure equipped with attachment means on its undersurface for removably securing said structure to wall supports, particularly to the opposed, interior side walls of a medicine cabinet.

2. Description of the Prior Art

There exist in the prior art a variety of shelf assemblies which provide a stationary horizontal surface for storage of objects. Those assemblies having removable shelves, as, e.g., in medicine cabinets, require special care in design and handling. This is especially true of removable glass shelves because of the fragility of the glass. A way of protecting the glass shelves during shipment has been to specially wrap them and thus ship them uninstalled. This practice disadvantageously adds to the complexity and cost of supplying the medicine cabinets.

It would be highly desirable if an improved shelf assembly could be found which does not require wrapping of the shelves for shipping protection. This shelf assembly should also be simple to manufacture through the utilization of economical materials and methods of construction.

OBJECTS OF THE INVENTION

It is therefore an object of the present invention to provide an improved shelf structure which can be shipped after being installed in a medicine cabinet, thereby eliminating the need for separately shipping and protectively wrapping the shelf structure.

It is another object of the present invention to provide a shelf structure which has a simple design and can be easily installed in and removed from a supporting structure.

It is yet another object of the present invention to provide a simple and efficient means for locking a shelf structure to a supporting structure.

It is still another object of the present invention to provide a shelf structure having locking means for engagement with a supporting structure, said locking means additionally providing strength to the shelf structure in supporting articles placed thereon.

It is a further object of the present invention to provide a shelf structure which is simple to manufacture through the utilization of economical materials and methods of construction and which can be installed in existing bathroom cabinets, without the need for any modification of the latter.

These and other objects of the invention will become more apparent as the description thereof proceeds.

SUMMARY OF THE INVENTION

The above objects were achieved in the shelf structure of the invention which finds particular application in a bathroom cabinet. The shelf structure includes a shelf body having at least one gripping projection on its undersurface, said at least one gripping projection being adapted to lockingly engage with a support projection or projections of a supporting structure.

The invention, more particularly, resides in a shelf structure for attachment to a bathroom cabinet comprising a shelf body having a pair of spaced gripping and strengthening projections, each of said projections extending longitudinally from one side edge to the other along the undersurface of said shelf body. The gripping projections are preferably integrally attached to the undersurface of the shelf body. The shelf body and gripping projections can be simply formed from a plastic material into an integral shelf structure by an extrusion process. The shelf structure is lockingly attached to the two opposed side walls of the bathroom cabinet by engagement of each of the gripping projections at its sides with opposed lateral projections on each of the side walls.

DESCRIPTION OF THE DRAWINGS

In the drawings:

FIG. 1 is a perspective view of a cabinet with a removable shelf of the invention aligned for insertion therein;

FIG. 2 is an enlarged side view of the shelf of FIG. 1;

FIG. 3 is an enlarged bottom view of the shelf of FIG. 1; and

FIG. 4 is an enlarged fragmentary side sectional view showing two shelves of the invention in engagement with lateral projections of the right side wall of FIG. 1, with the cabinet door closed.

DETAILED DESCRIPTION OF THE INVENTION

This invention will be described as embodied in the shelf assembly constructed as illustrated in FIGS. 1–4. In FIG. 1 there is shown a cabinet 10 and cabinet door 11. Cabinet 10 comprises a housing having an open front side and facing rim 12, top and bottom walls 13 and 14, rear wall 15, and side walls 16 and 17. The cabinet is suitably fabricated from sheet metal or other appropriate material, such as a rigid plastic.

The door, which has a mirror visible from its front, is hinged to the cabinet in a conventional manner and stands in an open position in FIG. 1, revealing side supports 18 on the interior of right side wall 16 of the cabinet and a corresponding group of side supports 18 on the interior of left side wall 17, as viewed in FIG. 1 from the exterior of said side wall 17. Side supports 18 project laterally into the interior of cabinet 10. Sixteen such projections 18 are located on each of side walls 16 and 17. As illustrated in FIG. 1, projections 18 are arranged in four sets, each set containing four projections, two upper and two lower ones. It will be understood that the locations of the projections and the number thereof can be varied to provide differently arranged shelf assemblies within the cabinet. Of the four projections in each set, two projections **18*a* are located nearer the front exterior edge 19 of side wall 16 and two projections 18*b* are located nearer said side wall's rear interior edge 20, with the set's upper projection 18*a* and upper projection 18*b* interior of it being in the same horizontal plane. Similarly, the set's lower projection 18*a* and lower projection 18*b* interior of it are located in a common horizontal plane, and so forth for the remaining twelve projections on side wall 16**.

Correspondingly, the other opposed side wall 17 has sixteen lateral projections 18 located so as to be the mirror images of those of side wall 16. That is, each pair comprising an exterior projection **18*a* and its interior projection 18*b* on side wall 17 are located so that it lies in the same horizontal plane as the corresponding opposed pair on side wall 16**.

Each projection 18 of cabinet 10 advantageously comprises an arc-shaped, short, thin strip which is rigidly attached to its respective cabinet side wall. Each strip is constructed to extend laterally outwardly in a curved path from a first position on the interior surface of the cabinet side wall and terminate at another position spaced from the first on said interior surface. Each strip is suitably formed so as to be integral with the side wall's interior surface at the two termini of its arced extension and to be made of the same material as the side wall.

The arrangement of projections 18 in cabinet 10 illustrated in FIGS. 1 and 4 was originally designed to support four flat, rectangular glass shelves. Each of said glass shelves was installed in the cabinet so as to lie in the horizontal plane extending between a given set of four upper projections 18 (two on each opposed side wall) and the adjacent set of four lower projections 18 (two on each opposed side wall). As explained heretofore, this assembly involving the use of glass shelves suffered from various deficiencies. These deficiencies are overcome by using the shelf structures of the invention. Although the cabinet side supports 18 illustrated in the drawings were designed to engage with a shelf structure different from that of this invention, the latter shelf structure can nonetheless be utilized in conjunction with these supports. The shelf of the invention thus has the advantageous feature that it is employable in existing cabinet assemblies, thereby avoiding any retooling of the latter together with the attendant costs of such retooling.

It will be readily appreciated that many modifications within the scope of the invention are possible in the shelf support system illustrated in FIGS. 1–4. A greater or lesser number of lateral projections can be located on the supporting walls in various spatial arrangements. For example, a shelf structure of the invention can be supported by an arrangement wherein a single lateral projection is located on each opposed side wall, with both projections lying in a given horizontal plane. And, while projections 18 of the cabinet shown in FIGS. 1 and 4 are arc-shaped, the laterally extending, side support projections of the invention can have any shaped structure which is adapted to securely engage with the locking means on the shelf's undersurface (See below). For example, a thin plate-like horizontal projection can be located to extend forwardly from rear wall 15 for support of a shelf structure of the invention.

As illustrated in FIGS. 1–4, the shelf 21 of the invention includes a shelf body 22 with a generally flat horizontal plate 23 and locking means 24 on the undersurface 25 of plate 23. Shelf 21 can be made of any suitable material having sufficient rigidity for holding objects placed thereon. Suitable shelf materials include rigid plastic and metal, preferably rigid plastic. Plate 23 advantageously comprises a thin, rectangular piece of rigid plastic with peripherally continuous rims extending along both its front and rear longitudinal edges, each rim being raised slightly above the upper surface 26 of plate 23. The rims serve as containment means for things placed on the installed shelf and as strengthening ribs therefor. Preferably, the rims of plate 23 comprise an upturned lip 27 integral with and projecting from the plate's horizontally extending rear edge (i.e., the edge adjacent cabinet rear wall 15 when the shelf is installed) and a vertical strip 28 perpendicular to and integrally attached to the plate's opposed, horizontally-extending, front edge. As can be seen best in FIGS. 2 and 4, plate 23 is attached to strip 28 along a line on the strip running slightly below and parallel to the strip's upper horizontally extending edge, with the result that, after the shelf's installation in the cabinet, a small rectangular section of strip 28 projects above the horizontal plane of plate 23 while a larger rectangular section of it projects below said plane. Front strip or flange 28 adds strength to shelf 21 of the invention.

The locking means 24 of shelf 21 are designed for locking engagement with the lateral projections 18 of the two sidewalls 16 and 17. The locking means of shelf 21 preferably comprise two projections or legs **24*a* and 24*b*, each extending downwardly a short distance from the undersurface 25 of shelf 21 and then rearwardly a short distance L in the direction away from the vertical plane of front flange 28. Each leg 24 suitably has approximately the same thickness as shelf plate 23 and is advantageously integral with and composed of the same material as said plate. Shelf body 22 and legs 24 can be formed from a plastic material into an integral structure by an extrusion process. As shown in FIGS. 2 and 3, leg 24*a* is located nearer the shelf's front longitudinal edge and leg 24*b* nearer the shelf's rear longitudinal edge. The vertical, downwardly projecting part 29*a* of front leg 24*a* extends from one side edge to the other of plate 23 along a line 30*a* (See FIG. 3) on undersurface 25, said line 30*a* being spaced a short distance rearward from and parallel to the plate's front longitudinal edge. In a similar fashion, the vertical, downwardly projecting part 29*b* of rear leg 24*b* extends from one side edge to the other of plate 23 along a line 30*b* (See FIG. 3) on undersurface 25, said line 30*b* being spaced a short distance forward from and parallel to the plate's rear longitudinal edge. Projecting rearwardly for the distance L from each of the lower, longitudinally extending edges of vertical projections 29*a* and 29*b* is the horizontal part 31 of each leg. The rear free edge of each part 31 advantageously terminates in a downturned rim 32. About half the distance L to the rear of downwardly projecting leg segment 29*b* (of the rear leg) is a small ridge-like projection 33 which extends longitudinally from one side edge to the other along the undersurface of shelf plate 33. The portion 34 of shelf plate 23 extending backwardly from downwardly projecting leg segment 29*a* (of the front leg) for about half the distance L is thickened on its undersurface. Both protrusions 33 and 34 form pressure elements for holding lateral projections 18** in place and serve to strengthen the shelf body.

As illustrated in the side view of FIG. 2, each leg 24 together with the section of the shelf body 22 above it forms a generally U-shaped profile or channel. This channel extends longitudinally from one side edge to the other along the undersurface 25 of shelf body 22. Each opposed side edge portion of the leg channel serves as a receiving slot for the insertion therein of a lateral projection 18 of the cabinet. Only the upper lateral projections **18*a*, 18*b* of each 4 projection set of cabinet 10 are used for installation of the shelves of the invention. This means that 4 shelves can be installed in cabinet 10**.

The U-shaped slots provided at the opposed side edges of leg **24*a* and leg 24*b* are arranged on shelf body 22 so that the respective opposed upper side wall projections 18*a*, 18*a* and 18*b*, 18*b*, respectively, snugly fit into said slots when the shelf is installed. In placing each shelf 21 into the cabinet, the shelf is first aligned with its front longitudinal edge tilted upwardly from the horizontal for engagement of its rear leg 24*b* with a pair of opposed upper rear projections 18***b*, 18*b* (see FIG. 1). Then, by inserting the shelf backwardly into the cabinet so that its rear leg 24*b* passes over the upper front projections 18*a*, 18*a* and next pivoting the shelf downwardly into the horizontal plane, the shelf is brought to the position where the rear projections 18*b*, 18*b* are adjacent the side entry points of the leg 24*b* channel and the front projections 18*a*, 18*a* and adjacent the side entry points of the leg 24*a* channel. The shelf is then pushed horizontally backward so that each of the four projections enters into (by a sliding forced fit) and is gripped firmly within the respective channel-shaped opening provided. The downturned rim 32 of each leg segment 31 facilitates the entry of projections 18 into the channel-shaped openings. The shelf comes to rest with each of the side edge portions of leg segments 29*a*, 29*b* abutting a respective lateral projection 18. The vertical distance between each leg segment 31 and the overlaying shelf plate section is such that each projection 18 is securely gripped within the leg channel, with the downwardly projecting portions 33 and 34 above leg segments 31 pressing down on the enclasped projections 18.

FIG. 4 shows a side sectional view of two shelves in engagement with lateral projections of the right side wall 16 of cabinet 10. Cabinet door 11 is in the closed position. The upper shelf is fully engaged while the lower shelf is somewhat disengaged with its front flange 28 abutting against the interior surface of door 11. Cabinet 10 is suitably so constructed that the horizontal distance M between front flange 28 of the fully engaged shelf and the interior surface of closed door 11 is less than the horizontal length L of each leg segment 31. The effect of this is that, with the cabinet door closed, the shelf cannot become disengaged from the lateral projections 18.

It is seen that the legs and the shelf plate width are so dimensioned that, with the cabinet door closed, shelf 21 cannot become disengaged from its supports. Thus, before shipment of the cabinet and shelves of the invention, the shelves should first be installed in the cabinet and the cabinet door closed. The shelves are then shipped in place. The engagement of shelf legs 24 with cabinet projections 18 prevents accidental bumping up of the shelves and helps to prevent shipping damage.

Although the locking means of the shelf structure described above comprises two spaced grippers, it can be readily seen that one or more than two such gripping means can be located on shelf body 22. For example, one downwardly and then rearwardly projecting leg can be formed on undersurface 25 of the shelf body. Suitable support for this single gripping means can consist, for example, of opposed lateral projections on the two cabinet side walls or of a single plate-like projection extending forwardly from cabinet rear wall 15. Also, the gripping projections need not be extended from one side edge to the other of the shelf body. Thus, in the plastic shelf of the invention, a gripping projection might be located on shelf body undersurface 25 at each side thereof and separate strengthening rib(s) formed on said undersurface.

The present invention provides a novel self structure which can be simply fabricated from plastic materials. A cost reduction in both labor and materials is realized through the invention. The shelf structure gripping means allows in-place shipment in a cabinet. The need for separate wrapping of the shelves for shipping protection is thus eliminated. At the same time, the shape of the gripping means provides strength to the shelf structure for supporting articles placed thereon. The shelf is thus uniquely shaped both to provide flexural strength and to provide for the shelf's retention in a cabinet. The shelf can be used in existing bathroom cabinets, thus avoiding the need for any tooling change in the cabinets. Therefore, a direct field replacement of the plastic shelves of the invention for the glass shelves in use becomes possible.

Whereas the present invention has been described with respect to specific embodiments thereof, it should be understood that the invention is not limited thereto as many modifications thereof may be made. It is, therefore, contemplated to cover by the present application any and all such modifications as fall within the true spirit and scope of the appended claims.

We claim:

1. An integral plastic shelf structure comprising a shelf body having a pair of spaced gripping and strengthening projections which extend longitudinally from one side edge to the other along the undersurface of said shelf body, each of said gripping and strengthening projections extending downwardly a short distance from said undersurface of said shelf body and then rearwardly away from the front longitudinal edge of said shelf body for a short distance and being adapted to lockingly engage with two opposed side wall projections to thereby support said shelf structure, and two protrusions which extend longitudinally from one side edge to the other along said undersurface of said shelf body, one of said protrusions being located above each of the rearwardly extending portions of said gripping and strengthening projections.

2. The shelf structure of claim 1 wherein the shelf body has peripherally continuous rims extending along both its front and rear longitudinal edges, each rim being raised slightly above the upper surface of the shelf body.

3. The shelf structure of claim 2 wherein the rearwardly extending portion of each gripping and strengthening projection terminates in a downturned rim.

4. In a cabinet having a rear wall and two opposed side walls, (a) a number of paired projections extending laterally into the interior of said cabinet on each of said opposed side walls, each of said paired projections of one side wall lying in the same horizontal plane as a corresponding pair of projections of the opposed side wall, the projections of each pair being spaced horizontally from each other on each said opposed side wall, and the pairs being spaced apart in the vertical direction along each said opposed side wall, and (b) a shelf structure supported on each set of opposed pairs of lateral projections, each shelf structure comprising a shelf body having a pair of spaced gripping and strengthening projections, each of said spaced gripping and strengthening projections extending longitudinally from one side edge to the other along the undersurface of the shelf body, the front gripping and strengthening projection being adapted to lockingly engage the front opposed lateral projections and the rear gripping and strengthening projection being adapted to lockingly engage the rear opposed lateral projections.

5. The cabinet of claim 4 wherein each gripping and strengthening projection extends downwardly a short distance from the undersurface of the shelf body and then rearwardly away from the front longitudinal edge of said shelf body for a short distance, whereby each lateral projection is lockingly held within the respective slot provided at the side portion of the gripping and strengthening projection.

6. The cabinet of claim 5 wherein each shelf structure comprises an integral plastic structure.

7. The cabinet of claim 6 wherein two protrusions extend longitudinally from one side edge to the other along the undersurface of the shelf body, one of said protrusions being located above each of the rearwardly extending portions of the gripping and strengthening projections for holding the opposed lateral projections in place.

8. The cabinet of claim 7 wherein the shelf body has peripherally continuous rims extending along both its front and rear longitudinal edges, each rim being raised slightly above the upper surface of the shelf body.

9. The cabinet of claim 8 wherein the rearwardly extending portion of each gripping and strengthening projection terminates in a downturned rim.

10. The cabinet of claim 9 wherein the width of the shelf body and the rearward extension of each gripping and strengthening projection are so dimensioned that, with the cabinet door closed, the shelf structure cannot become disengaged from the lateral projections.

* * * * *